US008263917B2

(12) United States Patent
Matsuzawa et al.

(10) Patent No.: US 8,263,917 B2
(45) Date of Patent: Sep. 11, 2012

(54) MICROWAVE HEATING DEVICE AND HEATING METHOD

(75) Inventors: Mitsuhiro Matsuzawa, Kashiwa (JP); Shigenori Togashi, Abiko (JP); Shinji Hasebe, Kyoto (JP)

(73) Assignee: Hitachi, Ltd., Tokyo (JP)

( * ) Notice: Subject to any disclaimer, the term of this patent is extended or adjusted under 35 U.S.C. 154(b) by 397 days.

(21) Appl. No.: 12/706,033

(22) Filed: Feb. 16, 2010

(65) Prior Publication Data

US 2010/0206872 A1 Aug. 19, 2010

(30) Foreign Application Priority Data

Feb. 16, 2009 (JP) ..... 2009-032524

(51) Int. Cl.
*H05B 6/80* (2006.01)

(52) U.S. Cl. ..... 219/687; 219/678; 219/690

(58) Field of Classification Search ..... 219/678, 219/687, 690
See application file for complete search history.

(56) References Cited

U.S. PATENT DOCUMENTS

| | | | | |
|---|---|---|---|---|
| 4,207,452 | A | 6/1980 | Arai | |
| 4,897,281 | A * | 1/1990 | Arai et al. | 427/8 |
| 5,387,397 | A | 2/1995 | Strauss | |
| 6,120,741 | A | 9/2000 | Jacquault et al. | |
| 2003/0106891 | A1 * | 6/2003 | Fagrell et al. | 219/695 |
| 2003/0199099 | A1 | 10/2003 | King et al. | |
| 2004/0020923 | A1 | 2/2004 | Collins | |
| 2008/0264934 | A1 * | 10/2008 | Moreira et al. | 219/690 |

FOREIGN PATENT DOCUMENTS

| | | |
|---|---|---|
| JP | 2000-515064 | 11/2000 |
| JP | P2000-515064 | 11/2000 |
| JP | 2006-188666 | 7/2006 |
| WO | WO 98/04102 | 1/1998 |
| WO | WO 03/041856 | 5/2003 |

* cited by examiner

*Primary Examiner* — Phuc Dang
(74) *Attorney, Agent, or Firm* — Antonelli, Terry, Stout & Kraus, LLP.

(57) ABSTRACT

In a heating device having a microwave generator for generating microwaves, a waveguide for propagating the microwaves, a matching element for adjusting the impedance inside the waveguide and a flow pipe for passing a substance to be heated, an outer pipe of low dielectric constant is arranged to circulate a heat transfer medium for heat exchange around the flow pipe adapted to pass the heated substance and a circulation constant temperature bath is provided for adjusting the temperature of the heat transfer medium for heat exchange and for circulating it, so that microwaves are irradiated while adjusting the temperature of the heat transfer medium for heat exchange to a desired value by means of the circulation constant bath and circulating the heat transfer medium around the flow pipe.

6 Claims, 10 Drawing Sheets

MICROWAVE HEATING DEVICE AND HEATING METHOD

BACKGROUND OF THE INVENTION

The present invention relates to a microwave heating device and a heating method based on the device and more particularly, to a technique for controlling the temperature of a substance to be heated to a constant value while irradiating the heated substance with microwaves.

Nowadays, the microwave is widely used in a domestic microwave oven for cooking and besides, its use is spread industrially to, for example, gum vulcanization, drying of tea leaves and foodstuffs sterilization. Further, application of the microwave to chemical synthesis process has currently been started and a report has been made, as described in "Microwave-assisted Chemical Process Technology" supervised by Yuji Wada and published by CMC, purporting that in comparison with the conventional heating method, the microwave can be utilized for chemical reactions with more versatility as exemplified by improvements in reaction speed and in addition, patent applications concerning chemical reaction devices utilizing microwaves have already been filed as disclosed in JP-A-2006-188666 and JP P2000-515064A.

In other words, it has been reported that the microwave heating is not based on a heating method using heat transfer from an external heat source as in the case of the conventional heating method but acts directly on molecules of a substance to be heated, thus drastically expediting speedup of heating as compared to the conventional heating method.

SUMMARY OF THE INVENTION

In chemical reactions, the reaction is generally accelerated by heating in many cases and necessarily, the temperature for heating is generally conditioned in many cases to a "temperature rise process" in which the temperature of the substance to be heated is raised to a target temperature or to a "sustained process" in which the substance to be heated is sustained at the target temperature for a constant time. In the heating method based on the microwave, however, the temperature of the substance rises without fail when energy of microwaves is absorbed in the substance to be heated, so that the temperature can be raised but the temperature of the substance to be heated is difficult to remain constant while irradiating the substance with microwaves. In this respect, the method disclosed in JP-A-2006-188666 can irradiate microwaves while passing a reaction liquid but in the prior art method, the temperature of the heated substance is difficult to sustain at a constant value. In the case of a microwave heating device of batch type, the temperature of a substance to be heated is controlled by adjusting the output of microwave through, for example, ON/OFF control of microwave output but with the microwave output turned ON, the temperature rises and with the microwave output turned OFF, the temperature lowers and controlling of the temperature to a constant value is still difficult to attain.

Under the circumstances as above, when performing a chemical reaction by utilizing microwaves, the temperature control is difficult, sometimes attended by bumping or thermal runaway and in the presence of bumping or thermal runaway, the flow of the liquid becomes uneven (irregular), giving rise to a problem that a stable reaction is difficult to proceed and control of reaction is difficult to achieve. Further, if the aforementioned bumping or thermal runaway causes the temperature to rise unexpectedly, a side reaction other than the intended reaction will sometimes take place or a product will possibly be deteriorated or its purity will possibly be degraded considerably.

Also, in the method described in WO2000-515064, a chemical reaction can be caused to proceed slowly or can be stopped by cooling a reaction liquid but it is difficult to perform such a control operation that the temperature of reaction liquid is adjusted to a constant value while passing the reaction fluid continuously and irradiating it with microwaves. Then, for control of the temperature of reaction liquid to a constant value, measurement of temperatures of the reaction liquid is necessary but in the method described in WO2000-515064 as above using an infrared ray sensor for temperature measurement, only temperatures prevailing principally on the surface can be measured and accurate measurement of the temperature of the reaction liquid is difficult to achieve.

The present invention is made in light of the aforementioned problems of the conventional technologies and more specifically, an object of the invention is to provide a microwave heating device which irradiates microwaves efficiently onto a substance to be heated while continuously passing the substance to be heated so that the temperature of the heated substance can be controlled to a constant value and a heating method based on the heating device as well.

To accomplish the above object, according to the present invention, a microwave heating device comprises a microwave generator for generating microwaves, a waveguide for propagating the microwaves generated from the microwave generator, a matching element for adjusting the impedance inside the waveguide and a flow pipe placed in the waveguide and intended to pass a substance to be heated, wherein the flow pipe forms a double pipe heat exchanger having an outer pipe through which a heat transfer medium for heat exchange can be circulated around the flow pipe and also having an inlet port to which the heat transfer medium flows in and an outlet port from which the heat transfer medium flows out, and wherein the microwave heating device further comprises a constant temperature bath for adjusting the heat transfer medium to a constant temperature, means for supplying the heat transfer medium to the inlet port, means for discharging the heat transfer medium from the outlet port and circulating it to the constant temperature bath, and means for causing the heated substance to flow to the flow pipe and means for causing the heated substance to flow out of the flow pipe.

According to the invention, a heating method based on the microwave heating device described as above comprises the steps of generating microwaves by means of the microwave generator, passing the substance to be heated to the flow pipe, and circulating a heat transfer medium adjusted to a desired temperature through the outer pipe, whereby the temperature of the substance to be heated is adjusted to a desired value while irradiating the heated substance with microwaves.

According to this invention, the reaction speed can expectedly be raised by the rapid heating with the help of microwaves and besides, the temperature of the substance to be heated can be sustained at a constant value while efficiently irradiating the microwaves onto the substance to be heated, thereby attaining advantageous effects that the aforementioned bumping or thermal runaway of the heated substance can be suppressed so as to improve safety and through suppression of the aforementioned side reaction, a stable reaction free from deterioration of a product and degradation in its purity can be carried out continuously.

Other objects, features and advantages of the invention will become apparent from the following description of the embodiments of the invention taken in conjunction with the accompanying drawings.

DETAILED DESCRIPTION OF THE EMBODIMENTS

A microwave heating device according to an embodiment of the present invention will now be described with reference to FIGS. 1 to 9 in the accompanying drawings.

Embodiment 1

Figure 1:
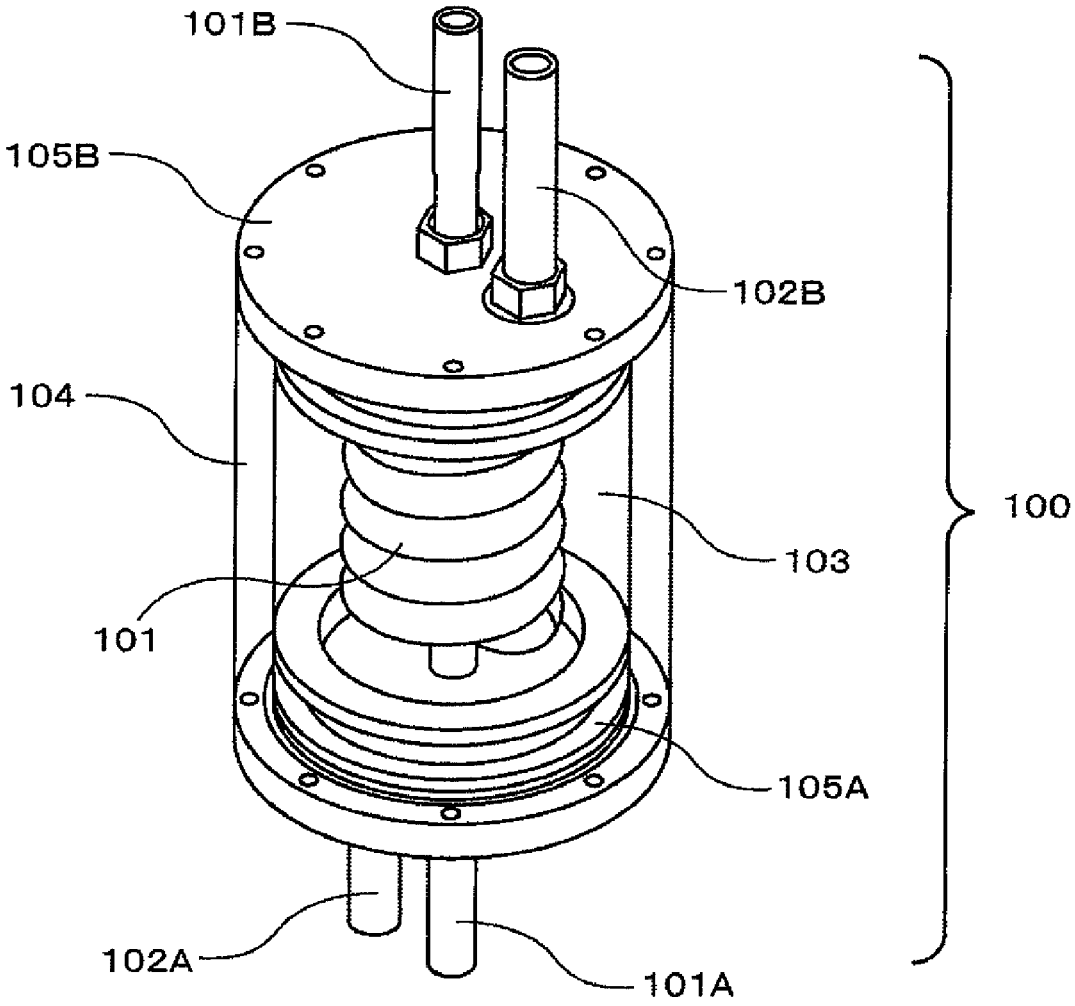
FIG. 1 is a perspective view illustrating a double pipe heat exchanger according an embodiment of the invention.
Figure 2:
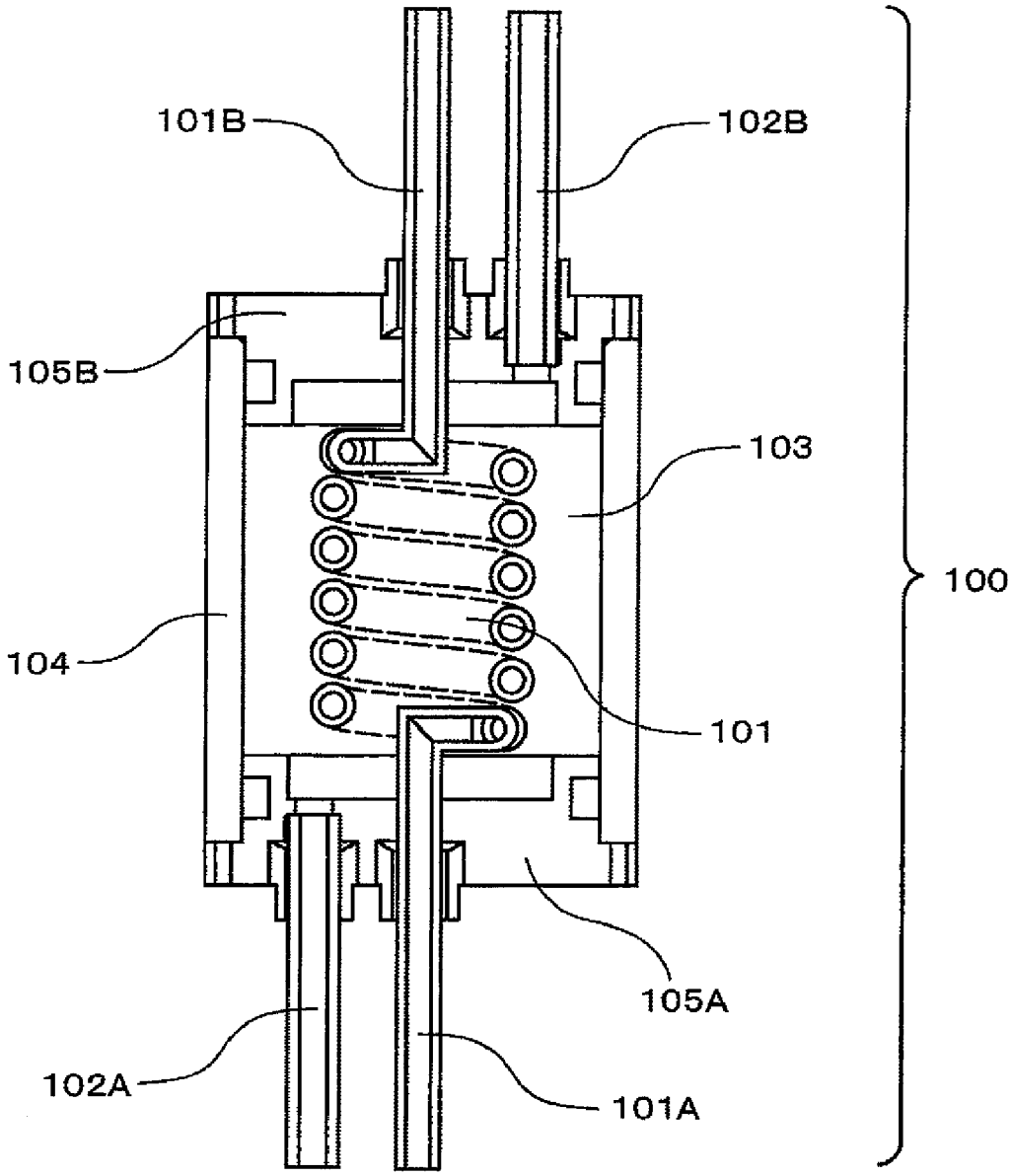
FIG. 2 is a longitudinal sectional view showing a detailed internal structure of the double pipe heat exchanger.

Referring first to FIGS. 1 and 2, a double pipe heat exchanger 100 in the present embodiment is illustrated in perspective view form and in longitudinal view form, respectively. As will be seen from these figures, the double pipe heat exchanger 100 is comprised of a flow pipe 101 for passing a substance to be heated, an outer pipe 104 adapted to circulate a heat transfer medium 103 for heat exchange around the flow pipe, a bottom lid 105A and a top lid 105B. Preferably, the flow pipe 101 is made of a material which has a small dielectric constant and hardly absorbs microwaves or is easy to transmit them, that is, exemplified by quartz, Teflon (registered trade name), resin typified by polycarbonate or glass. Similarly suited for the outer pipe 104 is the material, as exemplified by quartz, Teflon, resin typified by polycarbonate or glass, which has a small dielectric constant and hardly absorbs microwaves or is easy to transmit them.

On the other hand, suitable as the heat transfer medium 103 is a gas or liquid having a small dielectric constant, hardly absorbing microwaves and being easy to transmit them and herein exemplified by Fluorinert (trade name) produced by 3M Co., GALDEN (trade name) produced by Solvay Solexis Co., carbon tetrachloride or also, hydrocarbon such as hexane or silicone oil. Preferably, the dielectric constant of the heat transfer medium 103 is smaller than that of the substance to be heated flowing inside the flow pipe 101, specifically, amounting to 10 or less and more preferably, 5 or less at 2.45 GHz.

As the material of the bottom lid 105A and top lid 105B, a so-called electrically conductive material, for example, aluminum, SUS or copper which does not absorb but reflects microwaves or a material, such as quartz, Teflon or resin as typified by polycarbonate having a small dielectric constant, hardly absorbing microwaves or being easy to transmit them can be used properly depending on the utilization of the device. In the present embodiment, the outer pipe 104, bottom lid 105A, top lid 105B, heat transfer medium inlet port 102A, heat transfer medium outlet port 102B and flow pipe 101 are separately set up but all of them may be formed integrally from the same material. While in the present embodiment the flow pipe 101 is described as being helical type, this invention is not limited thereto and for example, a straight pipe or other shapes may be adoptable and besides, the cross-sectional form of the flow pipe may be, for example, circular or polygonal.

Figure 3:
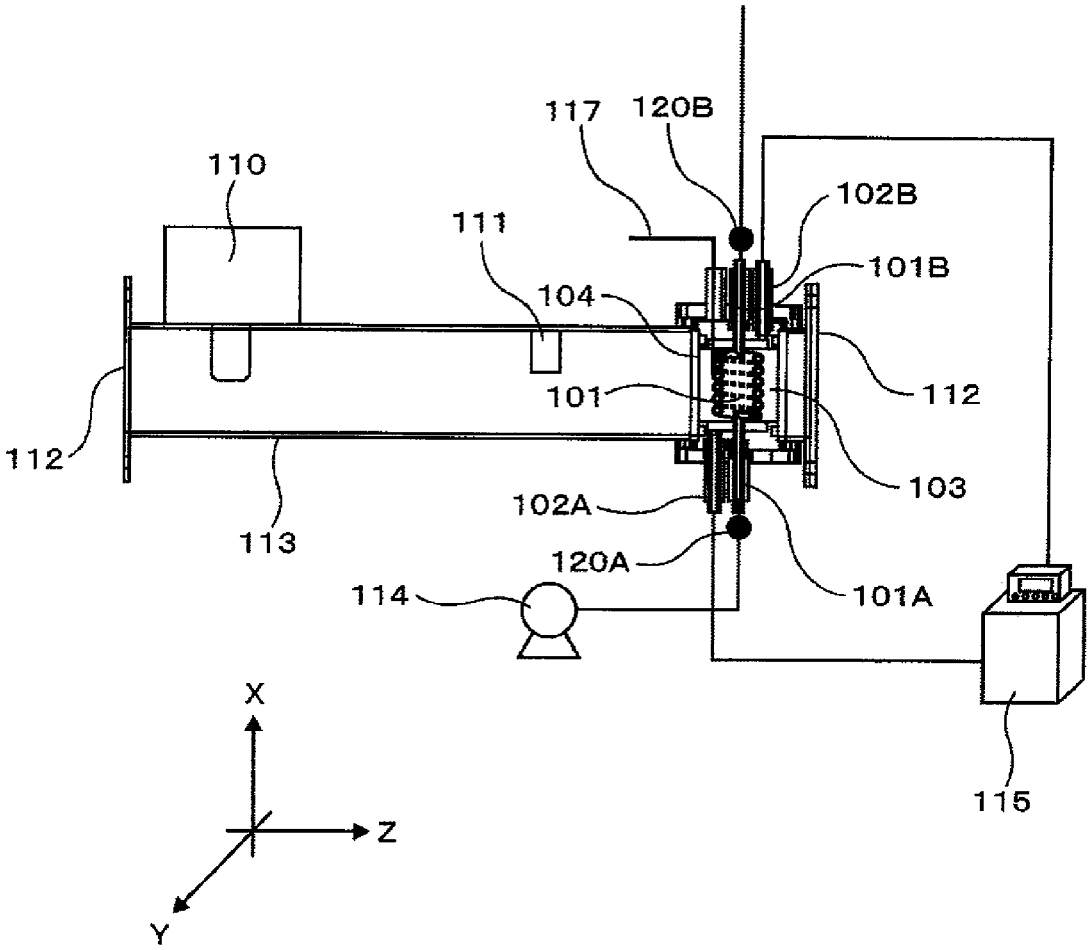
FIG. 3 is a diagram illustrating the overall configuration of a microwave heating device according to a first embodiment of the invention including the double pipe heat exchanger.

Turning now to FIG. 3, a configuration of a microwave heating device of waveguide type built in with the double pipe heat exchanger 100 structured as above according to the invention will be described. In FIG. 3, the height and lateral side (depth) of the waveguide are set to lie in X and Y directions, respectively, and the propagation direction of microwaves is set to lie in Z direction. In the figure, the waveguide designated at reference numeral 113 has opposite ends blocked by short-circuit planes 112 and it operates to propagate microwaves in TE 10 mode. At a position of the inner wall surface of waveguide 113 along the longitudinal center line, a matching element 111 for adjustment of the impedance inside the waveguide is provided. A magnetron 110 for generating microwaves at a frequency of 2.45 GHz is located at one end of the waveguide 113 and the double pipe heat exchanger 100 is located at the other end of the waveguide 113 while passing through upper and lower wall surfaces of waveguide 113 at a position along the longitudinal center line of waveguide 113. The waveguide 113, short-circuit plane 112 and matching element 111 are made of an electrically conductive material such as aluminum, SUS or copper. The flow pipe inlet port 101A is coupled with a pump 114 to enable a substance to be heated to pass through the interior of the flow pipe. A heat transfer medium inlet port 102A and a heat transfer medium outlet port 102B are connected with a circulation constant temperature bath 115 for adjusting the temperature of the heat transfer medium 103 to a desired value and for circulating it through the interior of the outer pipe.

For the purpose of controlling to a desired value the temperature of the substance to be heated passing through the flow pipe 101, measurement of temperatures of the substance to be heated is indispensable and in the present embodiment, thermocouples or fiber optic sensors are arranged at the inlet port 101A and outlet port 101B of the flow pipe. Further, in order for the temperature of the heated substance in the microwave irradiation environment to be measurable at least one point other than the input and output ports, at least one fiber optic sensor 117 is inserted in the waveguide. To permit the fiber optic sensor 117 to measure the temperature without being affected by the environment of an electromagnetic field and without having an influence upon the environment, the fiber optic sensor is made of, for example, optical fibers and more specifically, made of a raw material hardly absorbing the microwave and being easy to transmit it, such as quartz, glass or plastics as typified by methacrylic resin and its periphery is preferably covered with, for example, Teflon having high medicine resistant nature. Although not shown, between the magnetron 110 for generating microwaves and the matching element 111, an isolator for absorbing reflected waves only may preferably be disposed.

Next, the location where the double pipe heat exchanger 100 is installed in the waveguide 113 will be explained. Where E[V/m] represents electric intensity in the substance to be heated, σ[S/m] represents electric conductivity of the substance to be heated, ρ[kg/m$^3$] represents density of the substance to be heated and SAR (Specific Absorption Rate) [W/kg] represents energy absorbed per Kg of heated substance, the SAR is expressed by the following equation (1).

$$SAR = \frac{\sigma|E|^2}{2\rho} \tag{1}$$

Figure 4A:
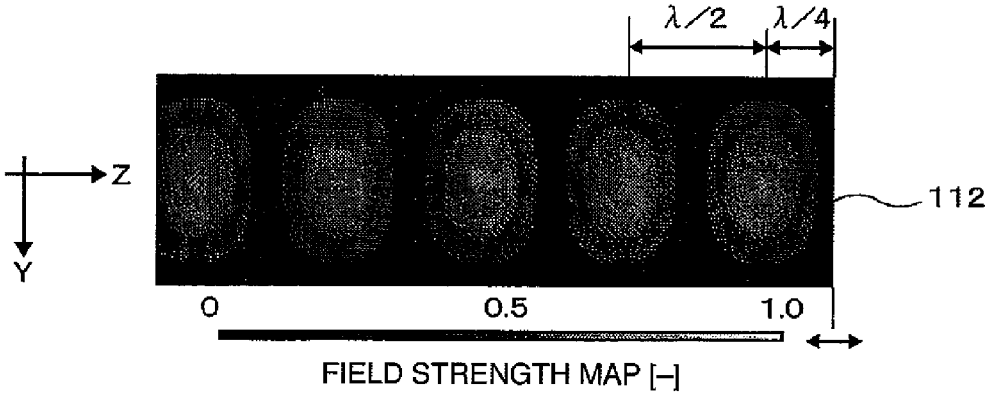
FIGS. 4A and 4B are diagrams showing electric field intensity distribution and magnetic field intensity distribution, respectively, inside a waveguide in the microwave heating device.
Figure 4B:
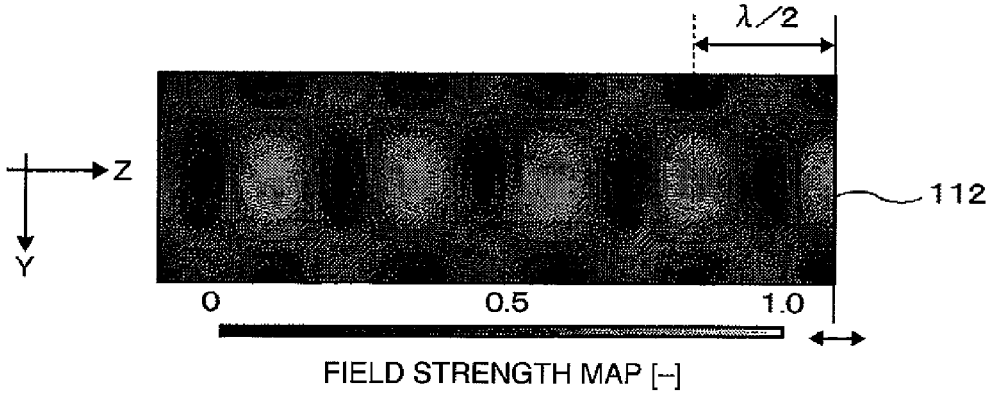

It will be seen from the above equation that the amount of microwave energy absorbed in the substance to be heated is proportional to the square of the electric intensity E. Accordingly, in order to raise the rate of energy absorption by the substance to be heated in the device according to the present embodiment, the flow pipe needs to be installed at a site where the electric intensity is maximized. In case nothing is arranged in the waveguide, the electric intensity and magnetic intensity are distributed on the YZ plane as shown in FIGS. 4A and 4B, respectively. In the X direction, both the electric field and magnetic field are constant.

In the present waveguide, incident waves generated from the magnetron 110 interfere with reflected waves from the short-circuit plane 112 to generate a standing wave. From FIGS. 4A and 4B, it will be seen that the electric field is maximized at portions distant from the short-circuit plane by $\lambda/4 \pm n \times \lambda/2$ (n=1, 2, 3, . . . ). Therefore, by locating the flow pipe at a site distant from the short-circuit plane by $\lambda/4 \pm n \times \lambda/2$ (n=1, 2, 3, . . . ), the microwave energy can be absorbed efficiently in the substance to be heated passing through the interior of the flow pipe. On the other hand, the magnetic field is inversely related to the electric field and is minimized at a site where the electric field is maximized but is maximized at a site where the electric field is minimized. In other words, the magnetic field is maximized at portions distant from the short-circuit plane by $n \times \lambda/2$ (n=1, 2, 3, . . . ). Accordingly, to examine the influence the magnetic field has, the double pipe heat exchanger is preferably arranged at a portion determined by $n \times \lambda/2$ (n=1, 2, 3, . . . ). Then, in the present embodiment, the short-circuit plane 112 is movable in the propagation direction of the microwave to ensure that the position of the double pipe heat exchanger 100 can be adjusted to a site where the electric intensity is strong or a site where the magnetic intensity is strong. Namely, the double pipe heat exchanger 100 is adjustable in its position. The electromagnetic intensity distribution is changed slightly when a matter is inserted in the waveguide but by adjusting the position of the short-circuit plane 112, the electromagnetic intensity can be optimized.

Next, operation based on the above configuration will be described with reference to FIG. 3.

The substance to be heated flows to the flow pipe inlet port 101A and thereafter flows out of the flow pipe outlet port 101B. The heat transfer medium 103 is set in advance to a desired temperature by the circulation constant temperature bath 115 and like the substance to be heated, flows to the heat transfer medium inlet port 102A and thereafter flows out of the heat transfer medium outlet port 102B. Preferably, the temperature of the heat transfer medium 103 is −100° C. or more and 200° C. or less. Microwaves generated from the magnetron 110 propagate through the waveguide 113 and absorbed in the heated substance passing through the interior of the flow pipe 101. In this procedure, the installation position of double pipe heat exchanger 100 and the position and length of matching element 111 are optimized in advance for making maximum the efficiency of absorption of the microwave energy by the heated substance. The outer pipe 104 is made of a material having a small dielectric constant such as quartz or Teflon and therefore the microwave energy is not absorbed by the outer pipe 104 but transmits through the outer pipe 104. In addition, since the heat transfer medium 103 is a substance having a small dielectric constant such as an inert liquid of hydrogen fluoride and therefore the microwave energy is not absorbed by the heat transfer medium 103 but transmits through it. Furthermore, since the flow pipe 101 is also made of a material of a small dielectric constant such as quartz, Teflon or resin, the microwave energy is not absorbed by the flow pipe 101 but transmits through it and is then absorbed in the heated substance passing inside the flow pipe 101.

The heated substance rises in temperature by absorbing the microwave energy as described above and in the present invention, heat exchange takes place between the heated substance and the heat transfer medium 103 by way of the flow pipe 101, so that the microwave energy absorbed in the heated substance gives rise to heat which in turn transfers to the heat transfer medium 103 through the flow pipe 101. As a result, even under irradiation of the microwave, the temperature of the heated substance can be kept constant. Then, in order for the heat exchange to be facilitated, the inner diameter of the flow pipe is preferably set to approximately several tens of μm to 10 mm. The thickness of pipe wall is preferably set to approximately several tens of μm to 3 mm. With these dimensions, the temperature of the heated substance can be adjusted to a desired value even under irradiation of the microwave and therefore, bumping or heat runaway can be suppressed and a chemical reaction can proceed safely, stably and efficiently even under irradiation of the microwave.

Operation of the matching element 111 will now be described.

Figure 5:
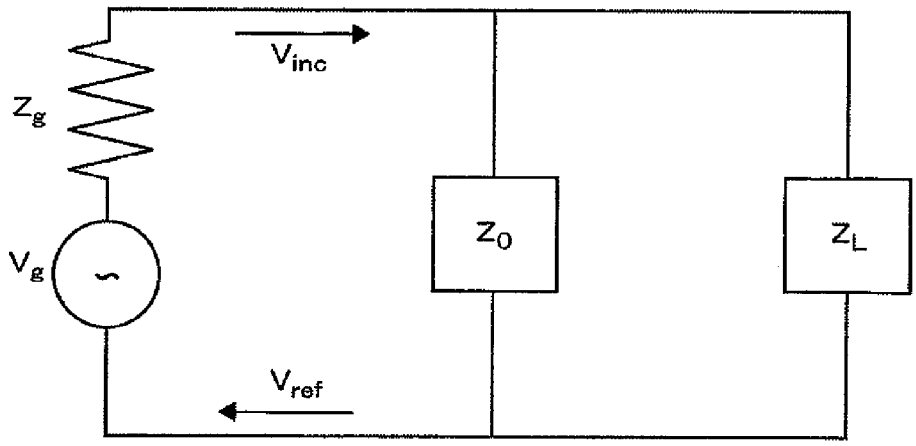
FIG. 5 is a circuit diagram showing an equivalent circuit of the microwave heating device according to the first embodiment of the invention.

Illustrated in FIG. 5 is an equivalent circuit of the device according to the present embodiment. Where power supply voltage is Vg, internal impedance of the power supply is Zg, load impedance of the substance to be heated is $Z_L$, characteristic impedance of the line is $Z_0$, incident voltage is $V_{inc}$, reflected voltage is $V_{ref}$ and coefficient of reflection is Γ, the reflected voltage $V_{ref}$ is expressed by equation (2) as below.

$$V_{ref} = \Gamma V_{in} = \frac{Z_L - Z_O}{Z_L + Z_O} V_{in} \tag{2}$$

From equation (2), it will be seen that when the load impedance $Z_L$ equals the characteristic impedance $Z_0$ of the line, the reflected wave becomes 0. Namely, at that time, the entire microwave energy is absorbed in the load. On the other hand, as the dielectric characteristic of the heated substance changes, the load impedance $Z_L$ varies and so the characteristic impedance $Z_0$ of the line must be adjusted correspondingly. With mere incorporation of the microwave generator and a unit capable of externally-forced cooling, microwaves are almost reflected and the microwave energy is prevented from being absorbed efficiently in the heated substance.

In the present invention, by changing the length and installation position of the matching element 111, the characteristic impedance $Z_0$ of the line can be adjusted. In other words, even when the kind of medical liquid to be passed and the unit inserted in the waveguide change and so the load impedance $Z_L$ changes correspondingly, by optimizing the length and installation position of the matching element 111, the microwave absorbed in the heat transfer medium 103 and in parts constituting the double pipe heat exchanger 100 can be suppressed as minimal as possible and the rate of absorption of the microwave in the heated substance can be optimized. Further, it is preferable that for fine adjustment, the position of the short-circuit plane 112 be adjustable in the direction of propagation of microwaves.

Figure 6:
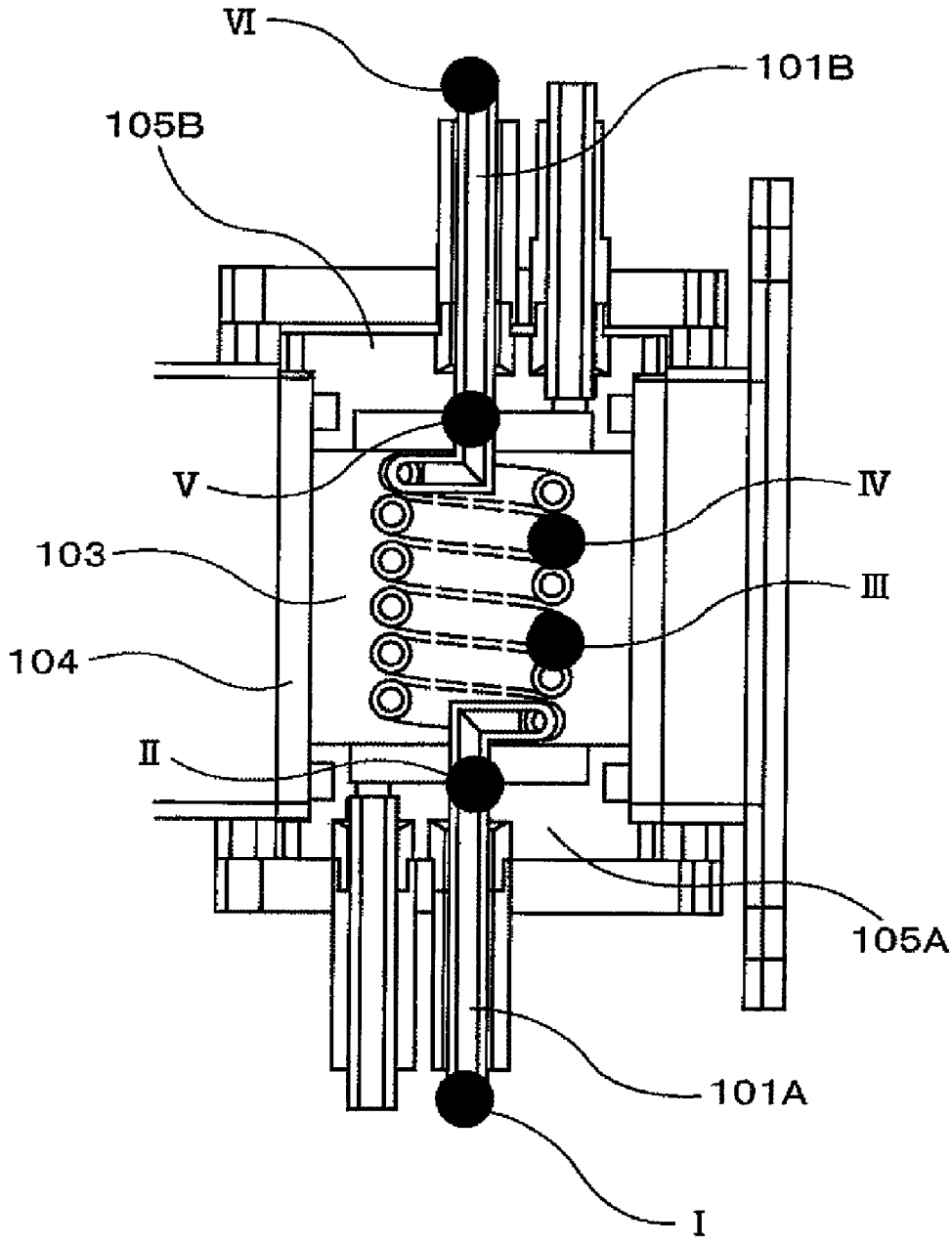
FIG. 6 is a longitudinal sectional view showing temperature measurement portions determined in a heating experiment carried out with the microwave heating device of the invention.
Figure 7:
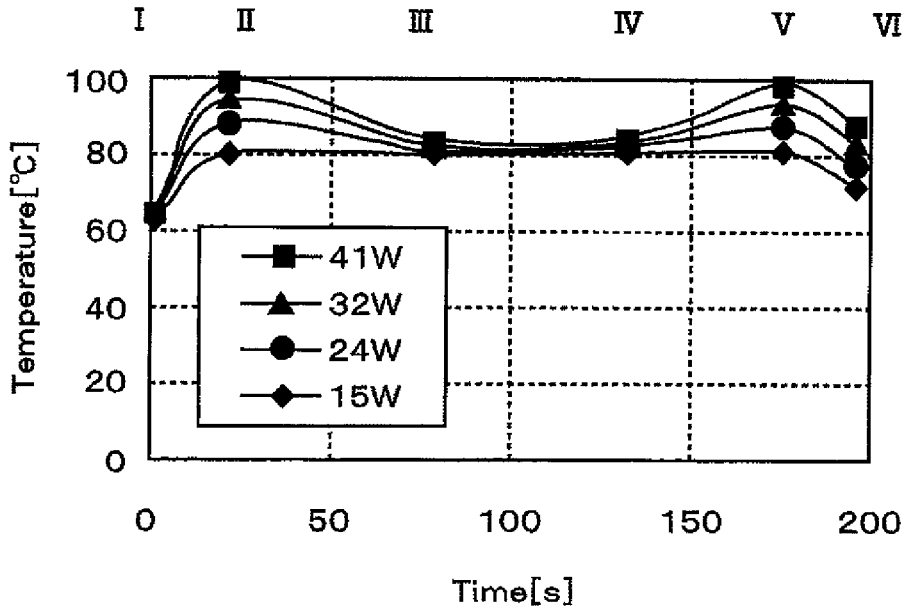
FIG. 7 is a graph showing an example of results of the heating experiment carried out with the microwave heating device of the invention.

Then, an experiment is conducted by inserting fiber optic sensors at respective points I to VI shown in FIG. 6 and irradiating microwaves while passing a mixture liquid of an organic solvent DMF (N,N-dimethylformamide) and water, obtaining results as shown in FIG. 7. In this case, the bottom lid 105A, top lid 105B and outer pipe 104 are all made of polycarbonate. Illustrated in FIG. 7 are temperature rise curves obtained when the mixture liquid of DMF and water at about 65° C. is passed to the flow pipe inlet port 101A, the heat transfer medium 103 at 80° C. on the other hand is circulated and the output of microwaves is changed. With the ordinary device, the temperature of the liquid absorbing microwaves is expected to continue rising and the temperature will rise as the liquid moves from the point I to the point VI. In the present device, however, the temperature remains substantially constant. Namely, in the device as constructed according to teachings of the present invention, the bottom lid 105A and top lid 105B are made of polycarbonate and so almost all the microwaves transmit through these lids and are absorbed by the heated substance whereas the heat transfer medium 103 for heat exchange does not contact at portions of points II and V, in other words, the effect of heat exchange is weak at these portions, with the result that as the output of the microwave increases, temperatures at the points II and V rise.

Figure 8:
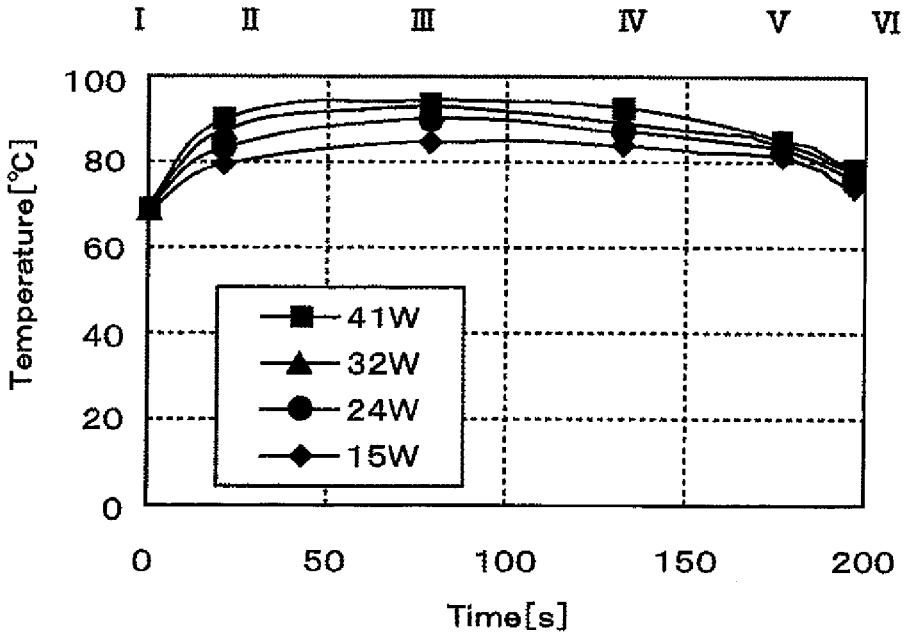
FIG. 8 is a graph showing another example of results of the heating experiment carried out with the microwave heating device of the invention.
Figure 9:
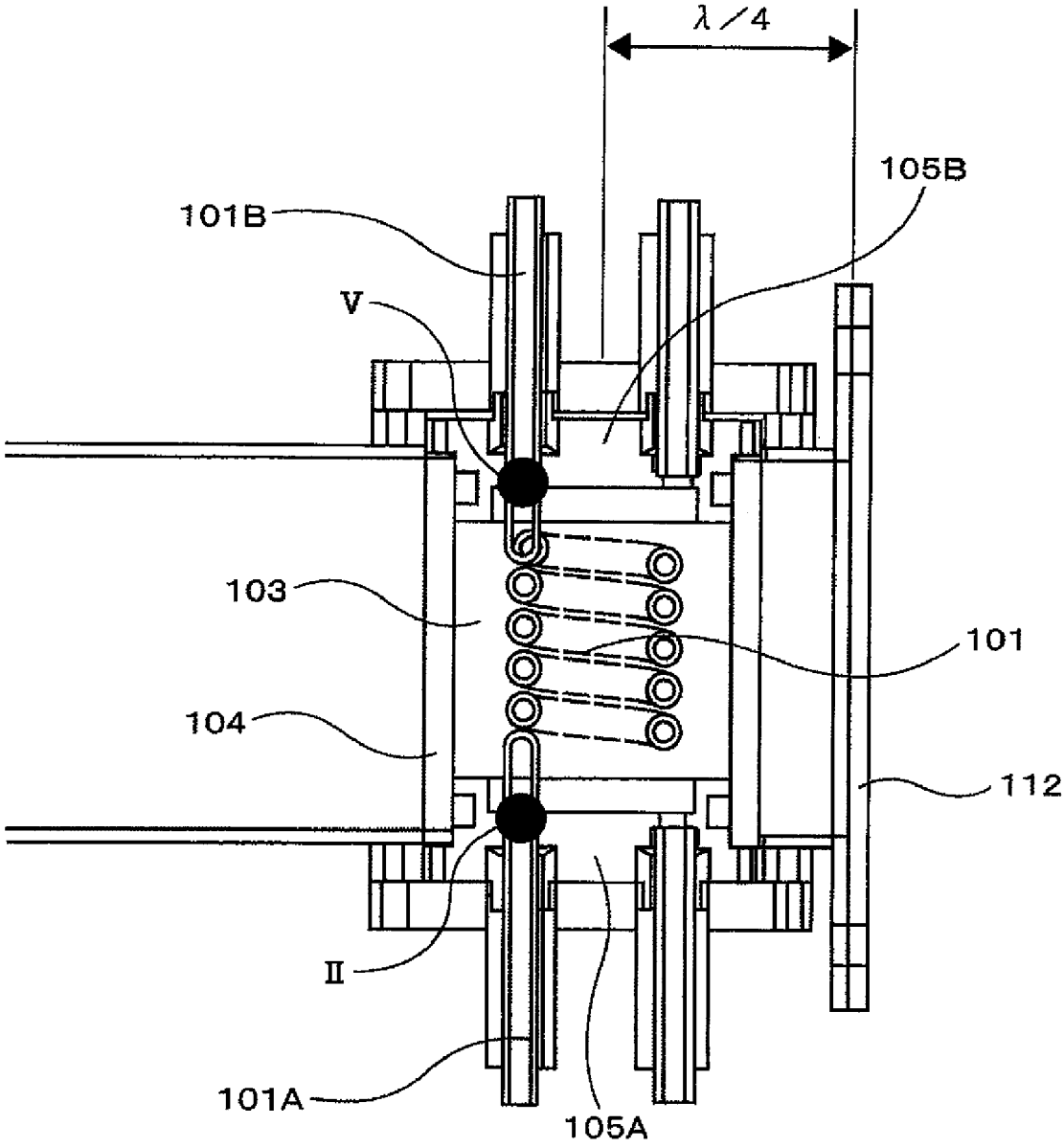
FIG. 9 is a longitudinal sectional view illustrating another form of the microwave heating device according to the first embodiment of the invention.

Next, an experiment is conducted by making the bottom lid 105A and top lid 105B from SUS and the outer pipe 104 from polycarbonate and microwaves are irradiated while circulating the heat transfer medium 103 at 80° C., obtaining results as shown in FIG. 8. With this construction, the material of the bottom lid 105A and top lid 105B is SUS and so the microwaves do not transmit through these lid, demonstrating that a rise in temperature due to concentration of microwaves does not take place at the points II and V and the temperature can be so controlled as to be substantially constant over points II to V. Further, when as shown in FIG. 9 the portions as indicated at II and V where the heat exchange effect is weak are so located as to deviate from the portions where the electric intensity is strong, that is, the portions being distant from the short-circuit plane 112 by $\lambda/4 \pm n \times \lambda/2$ (=1, 2, 3, . . . ), the temperature rise can be suppressed.

Embodiment 2

Figure 11:
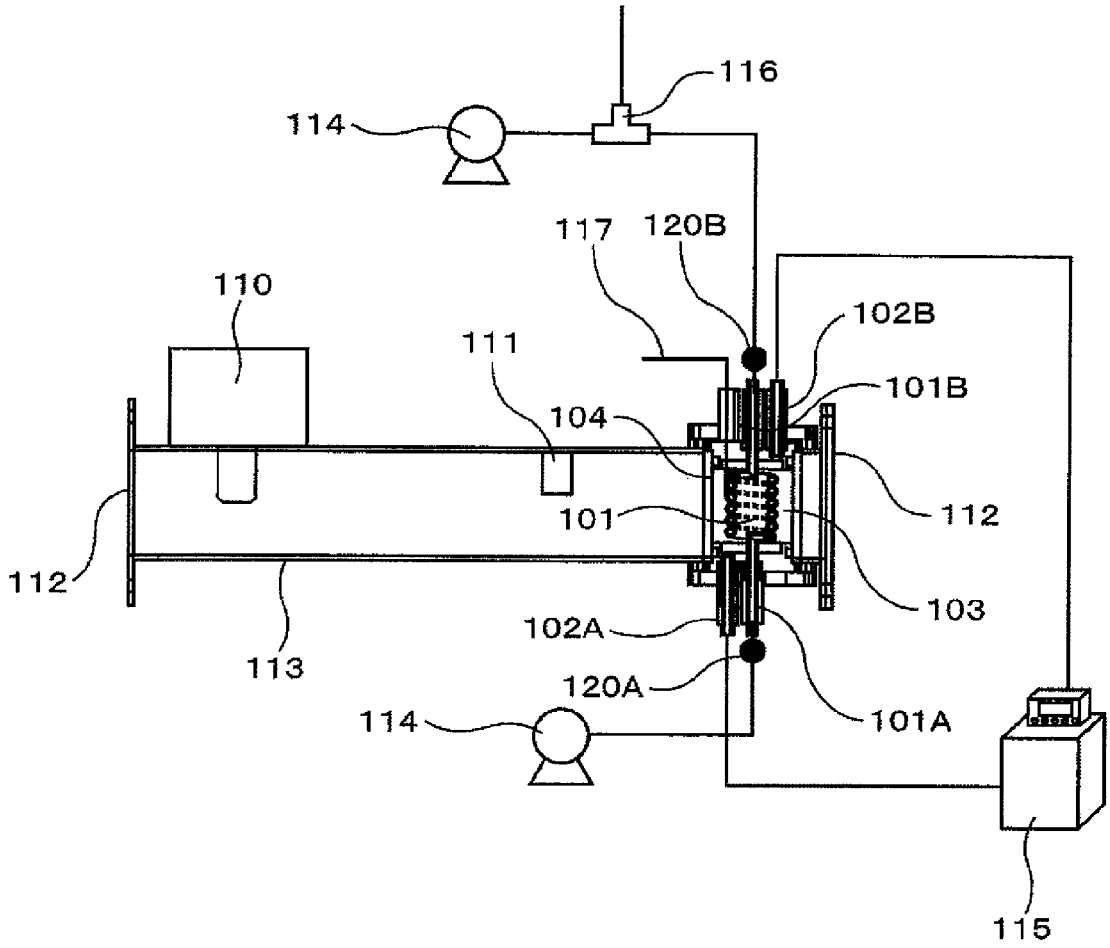
FIG. 11 is a diagram illustrating another form of the microwave heating device according to the second embodiment of the invention.
Figure 12:
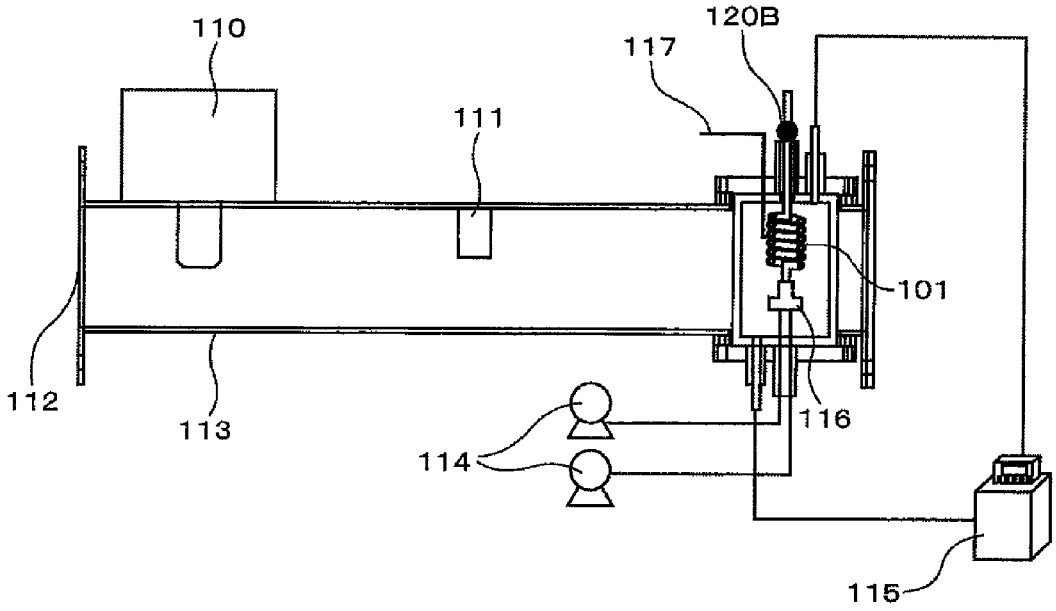
FIG. 12 is a diagram illustrating still another form of the microwave heating device according to the second embodiment of the invention.

Next, a second embodiment of the invention incorporating a micro-reactor 116 will be described with reference to FIGS. 10 to 12. The micro-reactor referred to herein is a reactor having flow channels of about several of tens of μm to several of hundreds of μm. Mixing of substances eventually depends on diffusion of molecules and time required for mixing is proportional to the square of the diffusion distance. Accordingly, in the micro-reactor, the diffusion distance is made to be small extraordinarily by use of the micro-channels to attain high-speed and efficient mixing unrealizable with the ordinary mixture. Then, in the configuration shown in FIG. 10, two kinds of different reagents are passed by use of pumps 114, the two liquids are mixed at a high speed by means of the micro-reactor 116 and microwaves are irradiated by means of the microwave irradiation unit described previously, so that high-speed mixing can be attained by the micro-reactor to advantage, along with execution of heating by the microwave, to ensure that a stable reaction can be attained which is improved in reaction efficiency.

Figure 10:
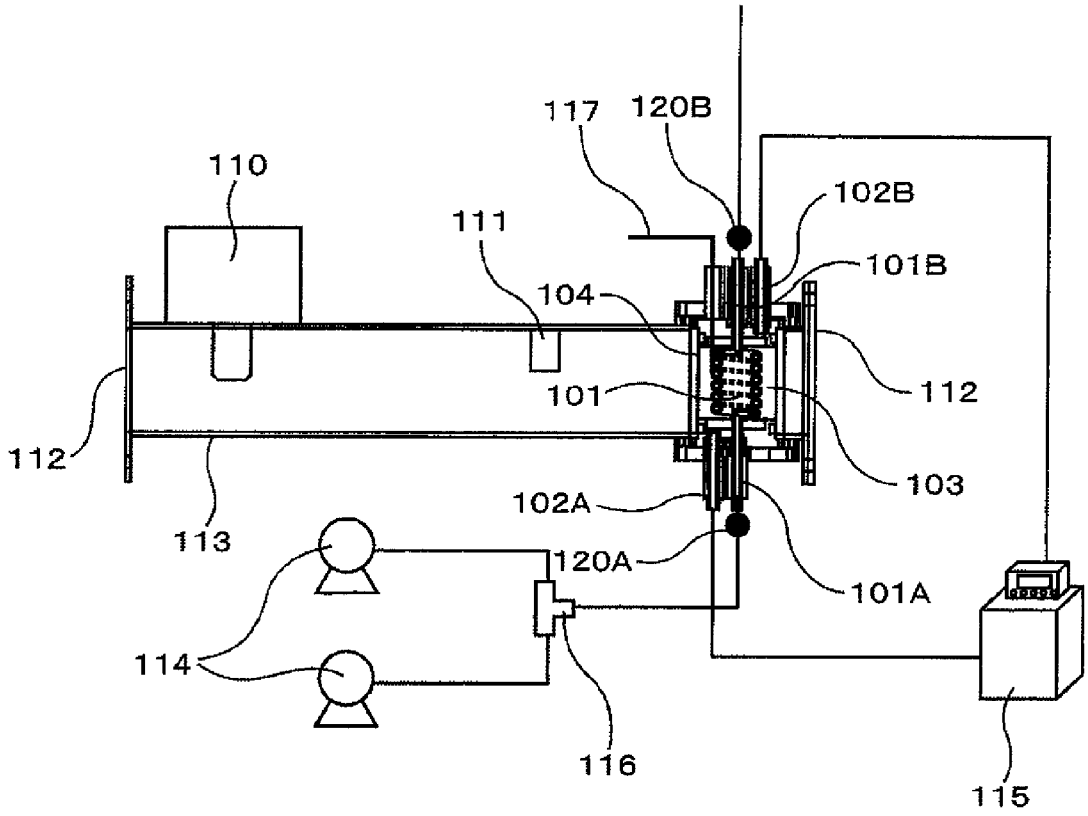
FIG. 10 is a diagram for explaining a microwave heating device according to a second embodiment of the invention.

In the embodiment shown in FIG. 10 is so described that the substances to be heated are mixed in the micro-reactor 116 and thereafter flown to the double pipe heat exchanger 100 so as to be irradiated with microwaves. But the invention is not limited thereto and as shown in FIG. 11, one substance to be heated is first irradiated with microwaves and thereafter subjected to mixing with another substance in the micro-reactor 116. Further, as shown in FIG. 12, the micro-reactor 116 is disposed in the waveguide 113 so that substances to be heated may be irradiated with microwaves and concurrently therewith, mixed in the micro-reactor 116. When it is desired that heated substances are mixed concurrently with irradiation with microwaves in FIG. 12, a material having a small dielectric constant such as quartz, resin typified by Teflon or glass is preferably used for the micro-reactor. If the microwave is not irradiated during mixing but is desired to be irradiated immediately after completion of mixing, an electrically conductive material such as SUS, that is, a microwave reflective material is preferable as the material of the micro-reactor. The present embodiment has been described as being of the waveguide type device construction but this is not limitative and the double pipe heat exchanger 100 may be installed in the multimode type device such as microwave oven and the substance to be heated may be heated while being irradiated with microwaves.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A microwave heating device comprising:

a microwave generator for generating microwaves;

a waveguide for propagating the microwaves generated by said microwave generator;

a matching element for adjusting the impedance inside said waveguide; and a flow pipe disposed in said waveguide to pass a substance to be heated, wherein said flow pipe forms a double pipe heat exchanger capable of circulating a heat transfer medium for heat exchange around said flow pipe and said double pipe heat exchanger has an inlet port to which said heat transfer medium flows in and an outlet port from which said heat transfer medium flows out, and wherein said microwave heating device further comprises:

a constant temperature bath for adjusting said heat transfer medium to a constant temperature;

means for supplying said heat transfer medium to said inlet port;

means for discharging said heat transfer medium from said outlet port and circulating it to said constant temperature bath;

means for causing the heated substance to flow to said flow pipe; and means for causing said heated substance to flow out of said flow pipe.

2. A microwave heating device according to claim 1, wherein said double pipe heat exchanger includes an outer pipe arranged exteriorly of said flow pipe to circulate said heat transfer medium around said flow pipe, said device further comprising a top lid and a bottom lid which close a space between said flow pipe and said outer pipe, and wherein said flow pipe is made of glass or resin, said outer pipe of said double pipe heat exchanger is made of glass or resin and said top and bottom lids are made of glass, resin or metal.

3. A microwave heating device according to claim 1, wherein said heat transfer medium for heat exchange is fluorine-inert liquid, hydrocarbon, carbon tetrachloride or silicone oil.

4. A microwave heating device according to claim 1, wherein a micro-reactor having micro-channels for mixing a plurality of kinds of solutions is connected to either at least one of inlet port and outlet port of said flow pipe or in the interior of said waveguide.

5. A microwave heating device according to claim 1, wherein at least one fiber optic sensor for measurement of the temperature of said heated substance is provided in the interior of said waveguide.

6. A microwave heating method based on the microwave heating device as recited in claim 1, comprising the steps of:

generating microwaves by means of said microwave generator;

passing a substance to be heated through said flow pipe; and circulating a heat transfer medium adjusted to a desired temperature through said outer pipe, whereby the temperature of said heated substance is adjusted to a desired value while irradiating said heated substance with microwaves.

* * * * *